US008863345B2

(12) United States Patent
Jimenez et al.

(10) Patent No.: US 8,863,345 B2
(45) Date of Patent: Oct. 21, 2014

(54) ORAL CARE IMPLEMENT HAVING A CLOSED-LOOP ARRANGEMENT OF CLEANING ELEMENTS

(75) Inventors: Eduardo Jimenez, Manalapan, NJ (US); Michael Rooney, Millburn, NJ (US); Robert Moskovich, East Brunswick, NJ (US); Joachim Storz, Zell am See (AT); Raimund Klausegger, Vienna (AT)

(73) Assignee: Colgate-Palmolive Company, New York, NY (US)

( * ) Notice: Subject to any disclaimer, the term of this patent is extended or adjusted under 35 U.S.C. 154(b) by 504 days.

(21) Appl. No.: 12/641,605

(22) Filed: Dec. 18, 2009

(65) Prior Publication Data

US 2011/0146014 A1 Jun. 23, 2011

(51) Int. Cl.

| | |
|---|---|
| ***A46B 9/04*** | (2006.01) |
| ***A46B 9/06*** | (2006.01) |
| ***A46B 15/00*** | (2006.01) |

(52) U.S. Cl.

CPC ... *A46B 9/04* (2013.01); *A46B 9/06* (2013.01); *A46B 15/0075* (2013.01); *A46B 15/00* (2013.01)

USPC ..... 15/167.1

(58) Field of Classification Search

USPC ..... 15/110, 167.1; D4/104

IPC ..... A46B 9/04,9/06

See application file for complete search history.

(56) References Cited

U.S. PATENT DOCUMENTS

| | | | | |
|---|---|---|---|---|
| 1,968,411 | A * | 7/1934 | Lukenbill | 15/172 |
| 2,117,174 | A | 5/1938 | Jones | |
| 2,978,724 | A * | 4/1961 | Gracian | 15/167.1 |
| 3,553,759 | A | 1/1971 | Kramer et al. | |
| 4,010,509 | A * | 3/1977 | Huish | 15/167.1 |
| 4,277,862 | A | 7/1981 | Weideman | |
| 5,305,489 | A | 4/1994 | Lage | |
| 5,335,389 | A | 8/1994 | Curtis et al. | |
| 5,341,537 | A | 8/1994 | Curtis et al. | |
| 5,392,483 | A | 2/1995 | Heinzelman et al. | |

(Continued)

FOREIGN PATENT DOCUMENTS

| | | |
|---|---|---|
| EP | 0449655 | 10/1991 |
| EP | 1607021 | 12/2005 |

(Continued)

OTHER PUBLICATIONS

International Search Report mailed on Apr. 26, 2011 for corresponding International Application No. PCT/US2009/068647.

*Primary Examiner* — Todd Manahan
*Assistant Examiner* — Jennifer Gill
(74) *Attorney, Agent, or Firm* — Thibault Fayette

(57) ABSTRACT

A toothbrush having an arrangement of cleaning elements for improved oral care and dentifrice retention. In one aspect, the invention is a toothbrush comprising a first set of cleaning elements forming a loop that extends from the distal periphery of the head to the proximal periphery of the head. The loop has the shape of a racetrack and comprises a first par-elliptical wall of cleaning elements at the distal periphery of the head and a second par-elliptical wall of cleaning elements located at the proximal periphery of the head. The par elliptical walls are connected first and second arcuate rows of cleaning elements. In one embodiment, the first and second arcuate rows are symmetrically arranged about the longitudinal axis so that peripheral convex surfaces of the first and second arcuate rows face the longitudinal axis.

33 Claims, 10 Drawing Sheets

(56) References Cited

U.S. PATENT DOCUMENTS

| | | | | |
|---|---|---|---|---|
| 5,446,940 | A | 9/1995 | Curtis et al. | |
| 5,459,898 | A | 10/1995 | Bacolot | |
| 5,604,951 | A * | 2/1997 | Shipp | 15/167.1 |
| 5,628,082 | A | 5/1997 | Moskovich | |
| 5,655,249 | A | 8/1997 | Li | |
| D390,706 | S | 2/1998 | Hohlbein et al. | |
| 5,742,972 | A | 4/1998 | Bredall et al. | |
| 5,758,383 | A | 6/1998 | Hohlbein | |
| D404,205 | S | 1/1999 | Hohlbein | |
| D404,206 | S | 1/1999 | Hohlbein | |
| 5,863,102 | A | 1/1999 | Waguespack et al. | |
| 5,946,758 | A | 9/1999 | Hohlbein et al. | |
| 5,970,564 | A | 10/1999 | Inns et al. | |
| 5,991,958 | A | 11/1999 | Hohlbein | |
| 6,041,468 | A | 3/2000 | Chen et al. | |
| 6,073,299 | A | 6/2000 | Hohlbein | |
| 6,088,870 | A | 7/2000 | Hohlbein | |
| D429,887 | S | 8/2000 | Hohlbein et al. | |
| 6,254,390 | B1 | 7/2001 | Wagner | |
| 6,276,021 | B1 | 8/2001 | Hohlbein | |
| D450,457 | S | 11/2001 | Hohlbein | |
| 6,314,606 | B1 | 11/2001 | Hohlbein | |
| D451,286 | S | 12/2001 | Hohlbein | |
| D456,138 | S | 4/2002 | Hohlbein | |
| D456,139 | S | 4/2002 | Hohlbein | |
| D457,323 | S | 5/2002 | Hohlbein | |
| D461,313 | S | 8/2002 | Hohlbein | |
| D461,642 | S | 8/2002 | Blaustein et al. | |
| D462,173 | S | 9/2002 | Eliav et al. | |
| 6,442,787 | B2 | 9/2002 | Hohlbein | |
| D464,133 | S | 10/2002 | Barnett et al. | |
| D474,608 | S | 5/2003 | Hohlbein | |
| 6,599,048 | B2 | 7/2003 | Kuo | |
| D478,216 | S | 8/2003 | Lee et al. | |
| 6,658,688 | B2 | 12/2003 | Gavney, Jr. | |
| D486,649 | S | 2/2004 | Sprosta et al. | |
| 6,820,299 | B2 | 11/2004 | Gavney, Jr. | |
| 6,820,300 | B2 | 11/2004 | Gavney, Jr. | |
| D502,322 | S | 3/2005 | Bava et al. | |
| 6,859,969 | B2 | 3/2005 | Gavney, Jr. et al. | |
| 6,938,293 | B2 | 9/2005 | Eliav et al. | |
| 6,944,903 | B2 | 9/2005 | Gavney, Jr. | |
| D511,249 | S | 11/2005 | Hohlbein | |
| D513,882 | S | 1/2006 | Hohlbein et al. | |
| D514,320 | S | 2/2006 | Hohlbein | |
| D514,812 | S | 2/2006 | Hohlbein et al. | |
| 6,996,870 | B2 | 2/2006 | Hohlbein | |
| D516,819 | S | 3/2006 | Hohlbein | |
| D517,812 | S | 3/2006 | Hohlbein et al. | |
| D517,813 | S | 3/2006 | Hohlbein et al. | |
| 7,007,332 | B2 | 3/2006 | Hohlbein | |
| 7,020,928 | B2 | 4/2006 | Hohlbein | |
| D520,753 | S | 5/2006 | Hohlbein | |
| 7,047,591 | B2 | 5/2006 | Hohlbein | |
| 7,069,615 | B2 | 7/2006 | Gavney, Jr. | |
| 7,089,621 | B2 | 8/2006 | Hohlbein | |
| D527,528 | S | 9/2006 | Hohlbein | |
| D528,803 | S | 9/2006 | Hohlbein | |
| D532,202 | S | 11/2006 | Hohlbein | |
| D532,607 | S | 11/2006 | Hohlbein | |
| 7,143,462 | B2 | 12/2006 | Hohlbein | |
| 7,146,675 | B2 | 12/2006 | Ansari et al. | |
| 7,168,125 | B2 | 1/2007 | Hohlbein | |
| 7,182,542 | B2 | 2/2007 | Hohlbein | |
| 7,213,288 | B2 | 5/2007 | Hohlbein | |
| 7,219,384 | B2 | 5/2007 | Hohlbein | |
| 7,273,327 | B2 | 9/2007 | Hohlbein et al. | |
| D557,504 | S | 12/2007 | Hohlbein | |
| D557,505 | S | 12/2007 | Hohlbein | |
| 7,322,067 | B2 | 1/2008 | Hohlbein | |
| D562,560 | S | 2/2008 | Hohlbein | |
| 7,331,731 | B2 | 2/2008 | Hohlbein et al. | |
| D569,625 | S | 5/2008 | Porter et al. | |
| 7,386,909 | B2 | 6/2008 | Hohlbein | |
| D577,493 | S | 9/2008 | Wong | |
| 7,458,125 | B2 | 12/2008 | Hohlbein | |
| 7,472,448 | B2 | 1/2009 | Hohlbein et al. | |
| 7,478,959 | B2 | 1/2009 | Hohlbein | |
| 7,480,955 | B2 | 1/2009 | Hohlbein et al. | |
| D589,256 | S | 3/2009 | Taylor et al. | |
| D589,260 | S | 3/2009 | Hohlbein | |
| 7,562,411 | B2 * | 7/2009 | Gavney, Jr. | 15/22.2 |
| D598,199 | S | 8/2009 | Russell et al. | |
| D599,556 | S | 9/2009 | Russell et al. | |
| 7,594,293 | B2 | 9/2009 | Xi et al. | |
| 7,721,376 | B2 | 5/2010 | Hohlbein et al. | |
| 7,722,274 | B2 | 5/2010 | Hohlbein et al. | |
| 7,735,174 | B2 | 6/2010 | Hohlbein et al. | |
| 7,743,448 | B2 * | 6/2010 | Gavney, Jr. | 15/22.1 |
| 2003/0208870 | A1 | 11/2003 | Jimenez | |
| 2003/0229959 | A1 | 12/2003 | Gavney et al. | |
| 2005/0091767 | A1 | 5/2005 | Jimenez et al. | |
| 2005/0166343 | A1 | 8/2005 | Gavney, Jr. | |
| 2005/0235439 | A1 | 10/2005 | Braun et al. | |
| 2006/0057087 | A1 * | 3/2006 | Moskovich et al. | 424/65 |
| 2006/0080799 | A1 | 4/2006 | Lucente | |
| 2006/0099162 | A1 * | 5/2006 | Moskovich et al. | 424/65 |
| 2006/0230563 | A1 | 10/2006 | Gavney, Jr. | |
| 2006/0272112 | A9 | 12/2006 | Braun et al. | |
| 2007/0033757 | A1 | 2/2007 | Storkel et al. | |
| 2007/0204417 | A1 * | 9/2007 | Russell et al. | 15/167.1 |
| 2007/0251040 | A1 | 11/2007 | Braun et al. | |
| 2007/0283517 | A1 | 12/2007 | Blanchard et al. | |
| 2007/0283518 | A1 | 12/2007 | Blanchard et al. | |
| 2008/0028558 | A1 | 2/2008 | Kwon | |
| 2008/0085827 | A1 | 4/2008 | Waguespack | |
| 2008/0178401 | A1 | 7/2008 | Claire-Zimmet et al. | |
| 2008/0271271 | A1 * | 11/2008 | Chan | 15/22.2 |
| 2009/0151101 | A1 * | 6/2009 | Bielfeldt et al. | 15/167.1 |
| 2010/0050356 | A1 | 3/2010 | Baertschi et al. | |
| 2010/0306941 | A1 * | 12/2010 | Erskine-Smith et al. | 15/167.1 |
| 2011/0308029 | A1 * | 12/2011 | Edelstein et al. | 15/167.1 |

FOREIGN PATENT DOCUMENTS

| | | |
|---|---|---|
| GB | 2375705 | 11/2002 |
| JP | 2002325632 | 11/2002 |
| JP | 2008302164 | 12/2008 |
| JP | 2009273760 | 11/2009 |
| WO | WO9409678 | 5/1994 |
| WO | WO9601578 | 1/1996 |
| WO | WO9628994 | 9/1996 |
| WO | WO9707706 | 3/1997 |
| WO | WO9807348 | 2/1998 |
| WO | WO0064307 | 11/2000 |
| WO | WO2004/019801 | 3/2004 |
| WO | WO2004112535 | 12/2004 |
| WO | WO2008090529 | 7/2008 |

* cited by examiner

ORAL CARE IMPLEMENT HAVING A CLOSED-LOOP ARRANGEMENT OF CLEANING ELEMENTS

FIELD OF THE INVENTION

The present invention relates generally to ansate oral care implements, and specifically to toothbrushes, either manual or powered, that have a handle and a head having cleaning elements for oral cleaning.

BACKGROUND OF THE INVENTION

A toothbrush is used to clean the teeth by removing plaque and debris from the tooth surfaces. Conventional toothbrushes provided with a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice is often spread around the mouth, rather than being concentrated on the contact of the bristles with the teeth. Therefore, the efficiency of the cleaning process is reduced.

While substantial efforts have been made to modify the cleaning elements of toothbrushes to improve the efficiency of the oral cleaning process and to hold the dentifrice in place during brushing, the industry continues to pursue arrangements of cleaning elements that will improve upon the preceding technology.

In an early attempt at improving the cleaning elements, toothbrushes were developed having two or three circular brush sections which are arranged within holders that may be screwed into mating receptacles in the tooth brush handle so that they can be removed and replaced as needed. Each brush section contains stiff cleaning elements and is spaced from the other along the longitudinal axis of the handle at a distance less than the thickness of a tooth so that the brush operates on both the lingual (inside) and facial (outside) surfaces of the teeth.

Another existing toothbrush includes a head containing a flexible, rubber-like prophylaxis polishing cup or "prophy cup" similar to that used by dental personnel to professionally clean teeth. This prophy cup is loaded with toothpaste by the user and applied to the teeth. The "soft rubber-like prophy cup device follows the contours of teeth more effectively than bristles." A ring of cleaning elements ("bristle tufts") are placed about the periphery of the toothbrush head which co-act with the prophy cups to clean the user's teeth and gums.

More recently, the strategic arrangement and combination of cleaning elements in the form of elastomeric prophy cups and bristle tufts has become more common as a way of improving cleaning efficiency and maintaining the dentifrice in place during brushing. One example of the combined use and strategic arrangement of elastomeric prophy cups and bristle tufts is a toothbrush having a head portion comprising a plurality of inner loops formed by elastomeric walls. The central inner loop is surrounded by outer loops formed of bristles. A central cleaning element, formed as a bristle tuft, is located within the elastomeric inner loop.

Another example of the combined use and strategic arrangement of elastomeric prophy cups and bristle tufts can be found in a toothbrush having a head portion comprising a plurality of soft elastomer prophy cups surrounded by bristle rings. In another embodiment, a toothbrush exists wherein the centralized prophy cups are formed by groups of densely packed cleaning elements that are surrounded by bristle rings. The bristle rings in this toothbrush are also disclosed as having one or more tufts at an inclination.

SUMMARY OF THE INVENTION

In one aspect, the invention can be a toothbrush comprising: a handle: a head connected to the handle, the head having a proximal periphery, a distal periphery, a first surface, a longitudinal axis and a lateral axis; a first set of cleaning elements forming a loop that extends from the distal periphery of the head to the proximal periphery of the head, the first set of cleaning elements comprising: a first par-elliptical wall of cleaning elements located at the distal periphery of the head, the first par-elliptical wall terminating in a first end and a second end; a second par-elliptical wall of cleaning elements located at the proximal periphery of the head, the second par-elliptical wall terminating in a first end and a second end; a first row of cleaning elements extending from the first end of the first par-elliptical wall to the first end of the second par-elliptical wall; and a second row of cleaning elements extending from the second end of the first par-elliptical wall to the second end of the second par-elliptical wall; wherein the first and second rows are symmetrically arranged about the longitudinal axis and the lateral axis, the first and second rows separated by a first distance that increases with distance from the lateral axis; a third row of cleaning elements extending adjacent to the first row and located along a first lateral periphery of the head, the third row located outside of the loop, the third row extending upward from the first surface at an incline so as to diverge from the first row, the third row having a height that is greater than a height of the first row; and a fourth row of cleaning elements extending adjacent to the second row and located along a second lateral periphery of the head, the fourth row located outside of the loop, the fourth row extending upward from the first surface at an incline so as to diverge from the second row, the fourth row having a height that is greater than a height of the second row.

In another aspect, the invention can be a toothbrush comprising: a handle: a head connected to the handle, the head having a proximal periphery, a distal periphery, a first surface and a longitudinal axis; a first set of cleaning elements forming a loop that extends from the distal periphery of the head to the proximal periphery of the head, the first set of cleaning elements comprising: a first par-elliptical wall of cleaning elements located at the distal periphery of the head, the first par-elliptical wall terminating in a first end and a second end; a second par-elliptical wall of cleaning elements located at the proximal periphery of the head, the second par-elliptical wall terminating in a first end and a second end; a first row of cleaning elements extending from the first end of the first par-elliptical wall to the first end of the second par-elliptical wall; and a second row of cleaning elements extending from the second end of the first par-elliptical wall to the second end of the second par-elliptical wall; a third row of cleaning elements extending adjacent to the first row and located along a first lateral periphery of the head, the third row located outside of the loop, the third row extending upward from the first surface at an incline so as to diverge from the first row, the third row having a height that is greater than a height of the first row; and a fourth row of cleaning elements extending adjacent to the second row and located along a second lateral periphery of the head, the fourth row located outside of the loop, the fourth row extending upward from the first surface at an incline so as to diverge from the second row, the fourth row having a height that is greater than a height of the second row.

In yet another aspect, the invention can be a toothbrush comprising: a handle: a head connected to the handle, the head having a proximal periphery, a distal periphery, a first surface and a longitudinal axis; a first set of cleaning elements forming a loop that extends from the distal periphery of the head to the proximal periphery of the head, the first set of cleaning elements comprising: a first par-elliptical wall of cleaning elements located at the distal periphery of the head, the first par-elliptical wall terminating in a first end and a second end; a second par-elliptical wall of cleaning elements located at the proximal periphery of the head, the second par-elliptical wall terminating in a first end and a second end; a first arcuate row of cleaning elements extending from the first end of the first par-elliptical wall to the first end of the second par-elliptical wall; and a second arcuate row of cleaning elements extending from the second end of the first par-elliptical wall to the second end of the second par-elliptical wall; and wherein the first and second arcuate rows are symmetrically arranged about the longitudinal axis so that peripheral convex surfaces of the first and second arcuate rows face the longitudinal axis.

In still another aspect, the invention can be a toothbrush comprising: a handle: a head connected to the handle, the head having a proximal periphery, a distal periphery, a first surface and a longitudinal axis; a first set of cleaning elements forming a loop that extends from the distal periphery of the head to the proximal periphery of the head, the first set of cleaning elements comprising: a first par-elliptical wall of cleaning elements located at the distal periphery of the head, the first par-elliptical wall terminating in a first end and a second end; a second par-elliptical wall of cleaning elements located at the proximal periphery of the head, the second par-elliptical wall terminating in a first end and a second end; a first row of cleaning elements extending from the first end of the first par-elliptical wall to the first end of the second par-elliptical wall; and a second row of cleaning elements extending from the second end of the first par-elliptical wall to the second end of the second par-elliptical wall; wherein a top surface of the loop has a longitudinal side profile that is a stretched out S-shape.

In a further aspect, the invention can be a toothbrush comprising: a handle: a head connected to the handle, the head having a proximal periphery, a distal periphery, a first surface and a longitudinal axis; a first set of cleaning elements forming a loop that extends from the distal periphery of the head to the proximal periphery of the head; and wherein a top surface of the loop has a longitudinal side profile comprising a concave section that extends from a peak at a distal-most point of the loop to a transition point at a middle-portion of the loop, and a convex section that extends from the transition point to a proximal-most point of the second par-elliptical wall.

BRIEF DESCRIPTION OF THE DRAWINGS

This invention is capable of use in a broad array of oral care implements and hygiene products. The drawings illustrate one use of the invention and are not to be construed as the only embodiment of the invention.

DETAILED DESCRIPTION OF THE DRAWINGS

In the following description, the invention is discussed in terms of a manual toothbrush incorporating the subject arrangement of cleaning elements. However, in other forms, the invention could be in the form of other oral care implements including a soft-tissue cleansing implement, a powered toothbrush, or other ansate implement designed for oral care.

Referring first to FIGS. 1-5 concurrently, a toothbrush 100 is illustrated according to one embodiment of the present invention. The toothbrush 100 generally comprises a handle 110 and a head 120. The handle 110 provides the user with a mechanism by which he/she can readily grip and manipulate the toothbrush 100. The handle 110 is generically illustrated and may be formed of many different shapes, sizes, materials and a variety of manufacturing methods that are well-known to those skilled in the art. If desired, the handle 110 may include a suitable textured grip (not shown) made of elastomeric material or can be a multi-part construction. Stated simply, the details of the handle 110 are not limiting of the present invention and, thus, require no further discussion for purposes of the present invention.

Figure 1:
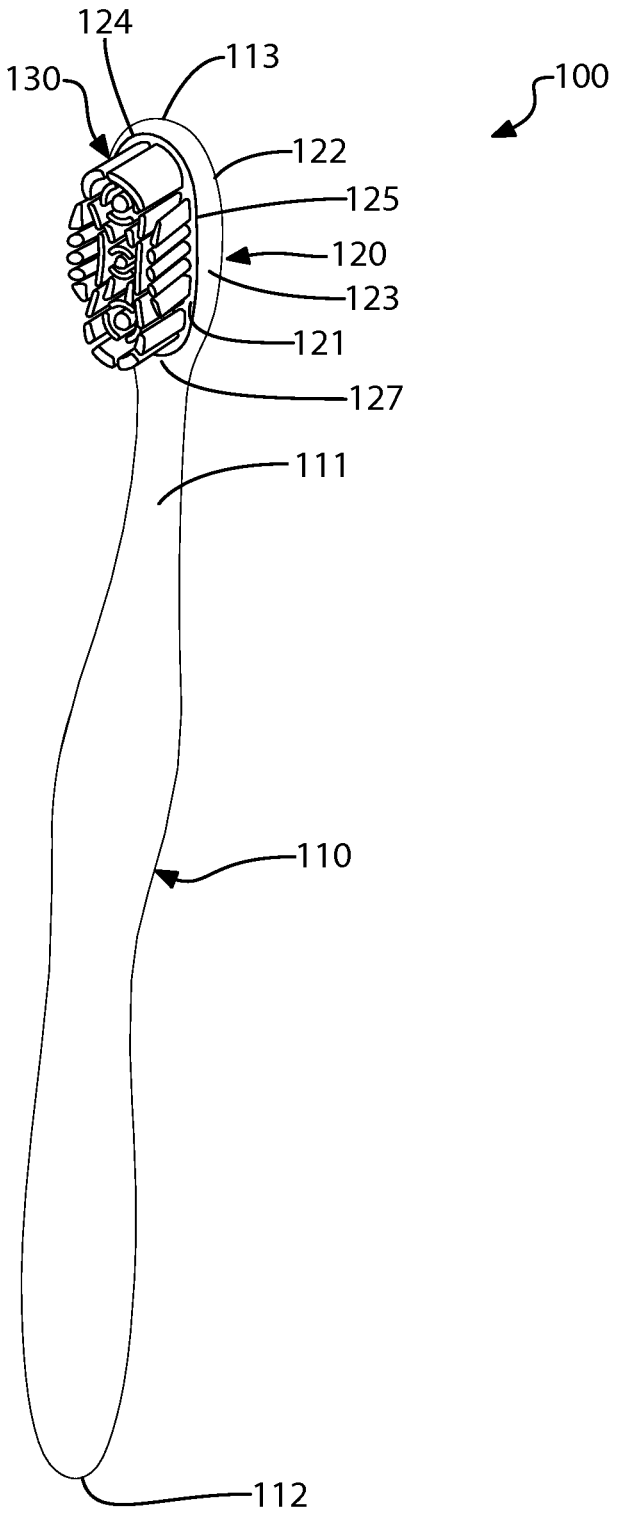
FIG. 1 is a perspective view a toothbrush according to one embodiment of the present invention.
Figure 2:
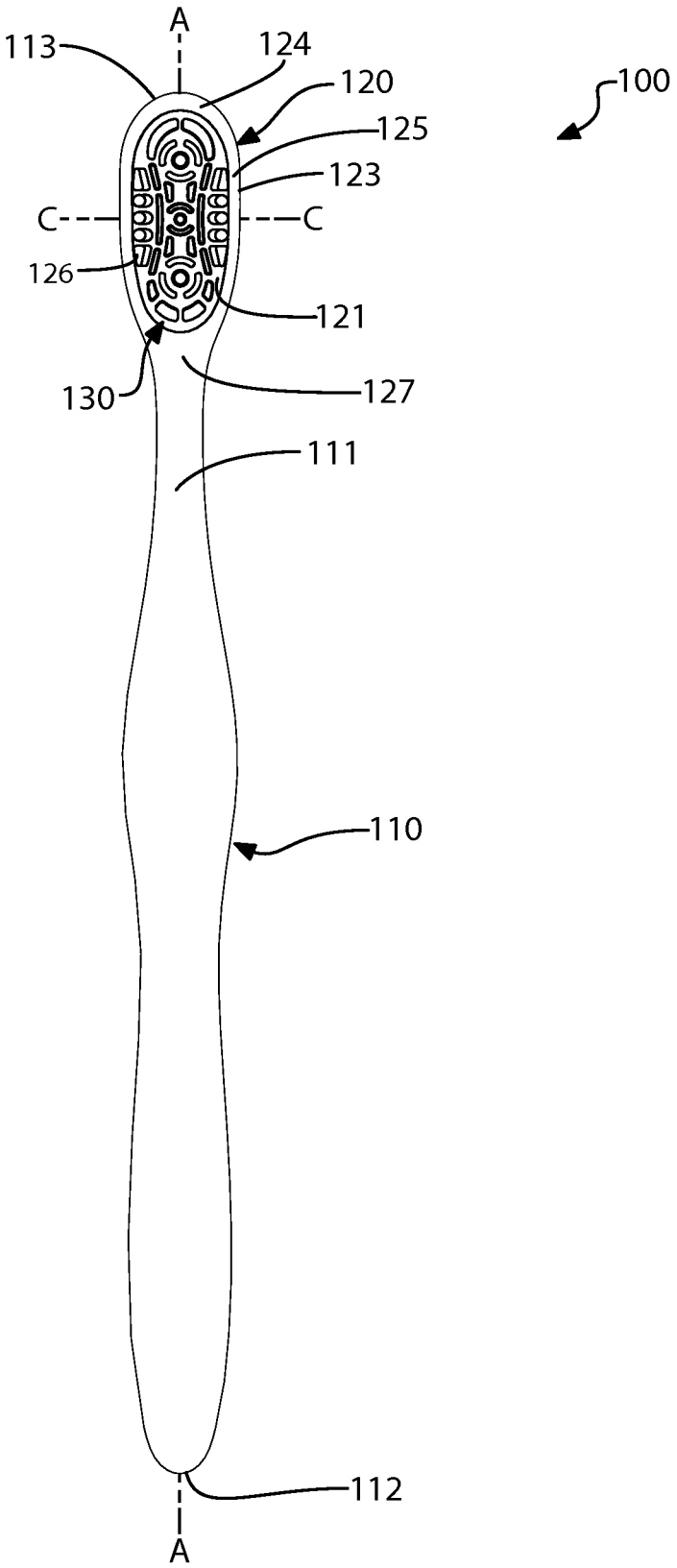
FIG. 2 is a front view of the toothbrush of FIG. 1.
Figure 3:
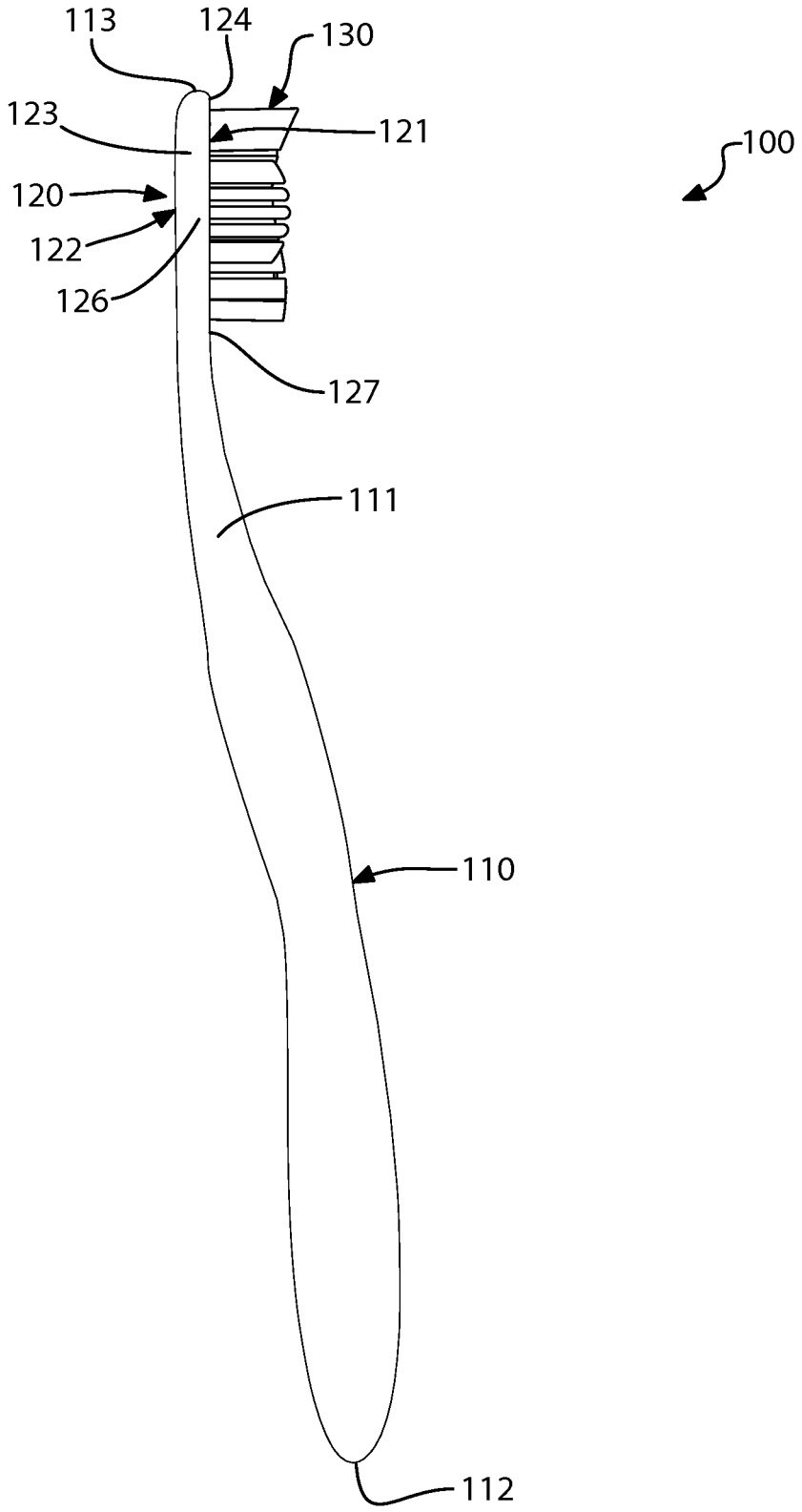
FIG. 3 is a left-side view the toothbrush of FIG. 1.
Figure 4:
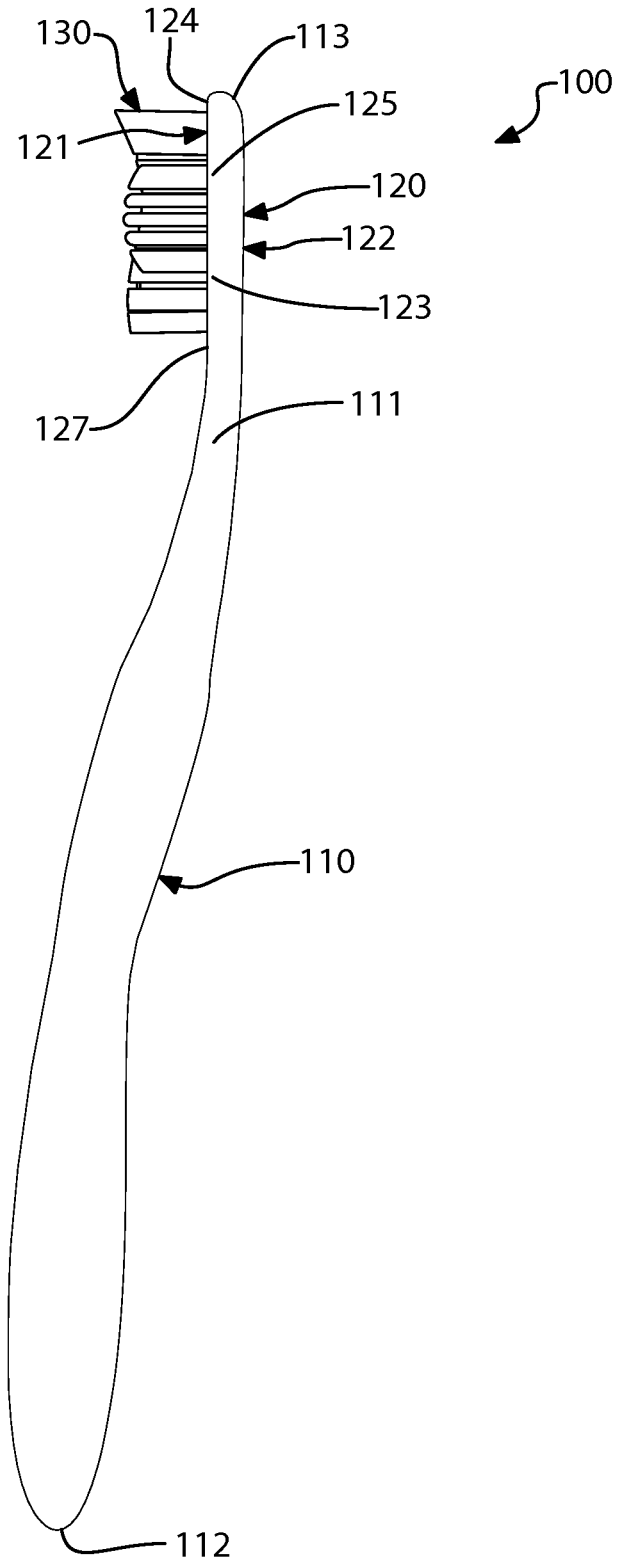
FIG. 4 is a right-side view the toothbrush of FIG. 1.
Figure 5:
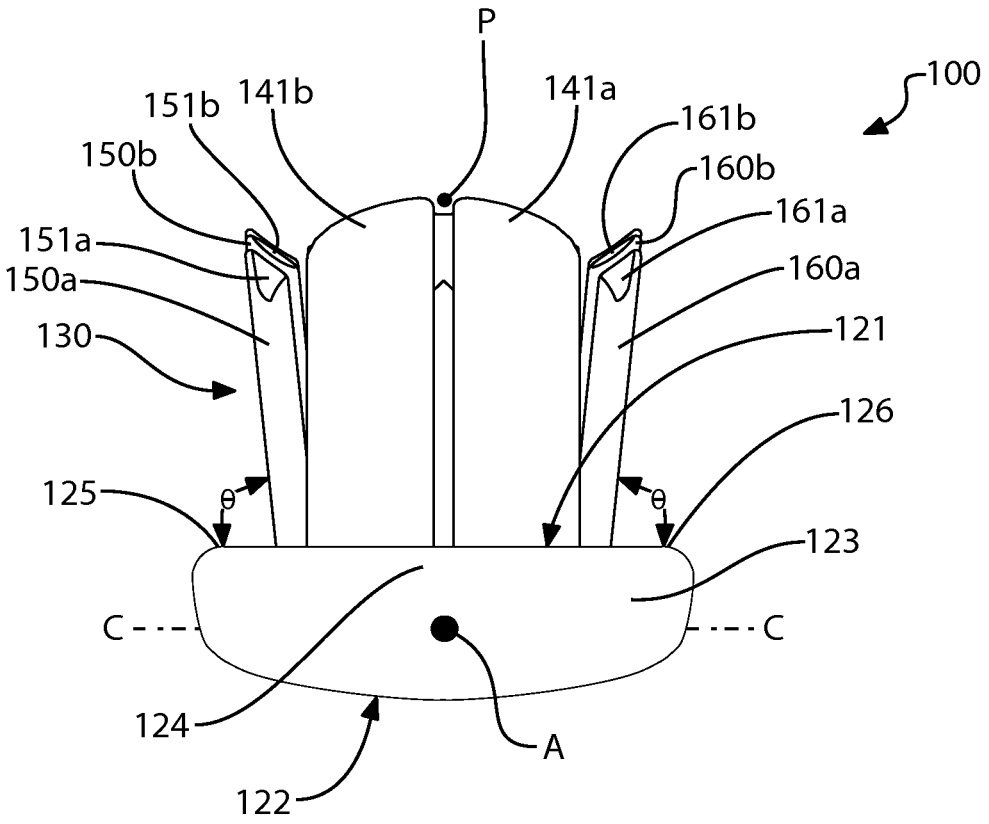
FIG. 5 is a top view of the toothbrush of FIG. 1.

The toothbrush 100 extends from a proximal end 112 to a distal end 113 along a longitudinal axis A-A (illustrated in FIG. 2). The head 120 is operably connected to the handle 110. The head 120 and handle 110 of the toothbrush are preferably formed as a single unitary structure using a molding, milling, machining or other suitable process. However, in other embodiments, the handle 110 and head 120 may be formed as separate components which are operably connected at a later stage of the manufacturing process by any suitable technique known in the art, including without limitation thermal welding, a tight-fit assembly, a coupling sleeve, adhesion, or fasteners. Whether the head 120 and handle 110 are of a unitary or multi-piece construction (including connection techniques) is not limiting of the present invention.

It should be noted at this time that relative terms such as distal, middle, proximal, upper, lower, top, bottom, left, right etc. are merely used to delineate relative positions of the components of the toothbrush 100 with respect to one another and are not intended to be in any further way limiting of the present invention.

The head 120 generally comprises a front surface 121 and a rear surface 122. The front surface 121 and the rear surface 122 of the head 120 can take on a wide variety of shapes and contours, none of which are limiting of the present invention. For example, the front and rear surfaces 121, 122 can be planar, contoured or combinations thereof. Moreover, if desired, the rear surface 122 may also comprise additional structures for oral cleaning, such as a soft tissue cleanser. An example of a suitable soft tissue cleanser is disclosed in U.S. Pat. No. 7,143,462, issued Dec. 5, 2006 to the assignee of the present application, the entirety of which is hereby incorporated by reference. Furthermore, while the head 120 is normally widened relative to the neck 111 of the handle 110, it could in some constructions simply be a continuous extension or narrowing of the handle 110.

The head 120 also comprises a distal periphery 124, a first lateral periphery 125, a second later periphery 126, and a proximal periphery 127. The distal periphery 124, the first lateral periphery 125 and the second later periphery 126 are bound by a peripheral side surface 123 of the head 120. The proximal periphery 127 is defined where the head 120 transitions into the neck 111.

A collection 130 of cleaning elements are provided on the front surface of the head 120 for cleaning contact with an oral surface, preferably teeth. While the collection 130 of cleaning elements is particularly suited for brushing teeth, the collection 130 of cleaning elements can also be used to clean oral soft tissue, such as a tongue, gums, or cheeks instead of or in addition to teeth. As used herein, the term "cleaning element" is used in a generic sense to refer to any structure that can be used to clean or massage an oral surface through relative surface contact. Common examples of "cleaning elements" include, without limitation, filament bristles, fiber bristles, nylon bristles, spiral bristles, rubber bristles, elastomeric protrusions, flexible polymer protrusions, co-extruded filaments, flag bristles, crimped bristles, anti-bacterial bristles and combinations thereof and/or structures containing such materials or combinations.

The collection 130 of cleaning elements of the present invention can be connected to the head 120 in any manner known in the art. For example, anchor free tufting (AFT) could be used to mount the cleaning elements. In AFT, a plate or membrane is secured to the brush head such as by ultrasonic welding. The bristles (or other elastomeric elements) extend through the plate or membrane. The free ends of the bristles on one side of the plate or membrane perform the cleaning function. The ends of the bristles on the other side of the plate or membrane are melted together by heat to be anchored in place. Any suitable form of cleaning elements may be used in the broad practice of this invention. Alternatively, the bristles could be mounted to tuft blocks or sections by extending through suitable openings in the tuft blocks so that the base of the bristles is mounted within or below the tuft block.

Figure 6:
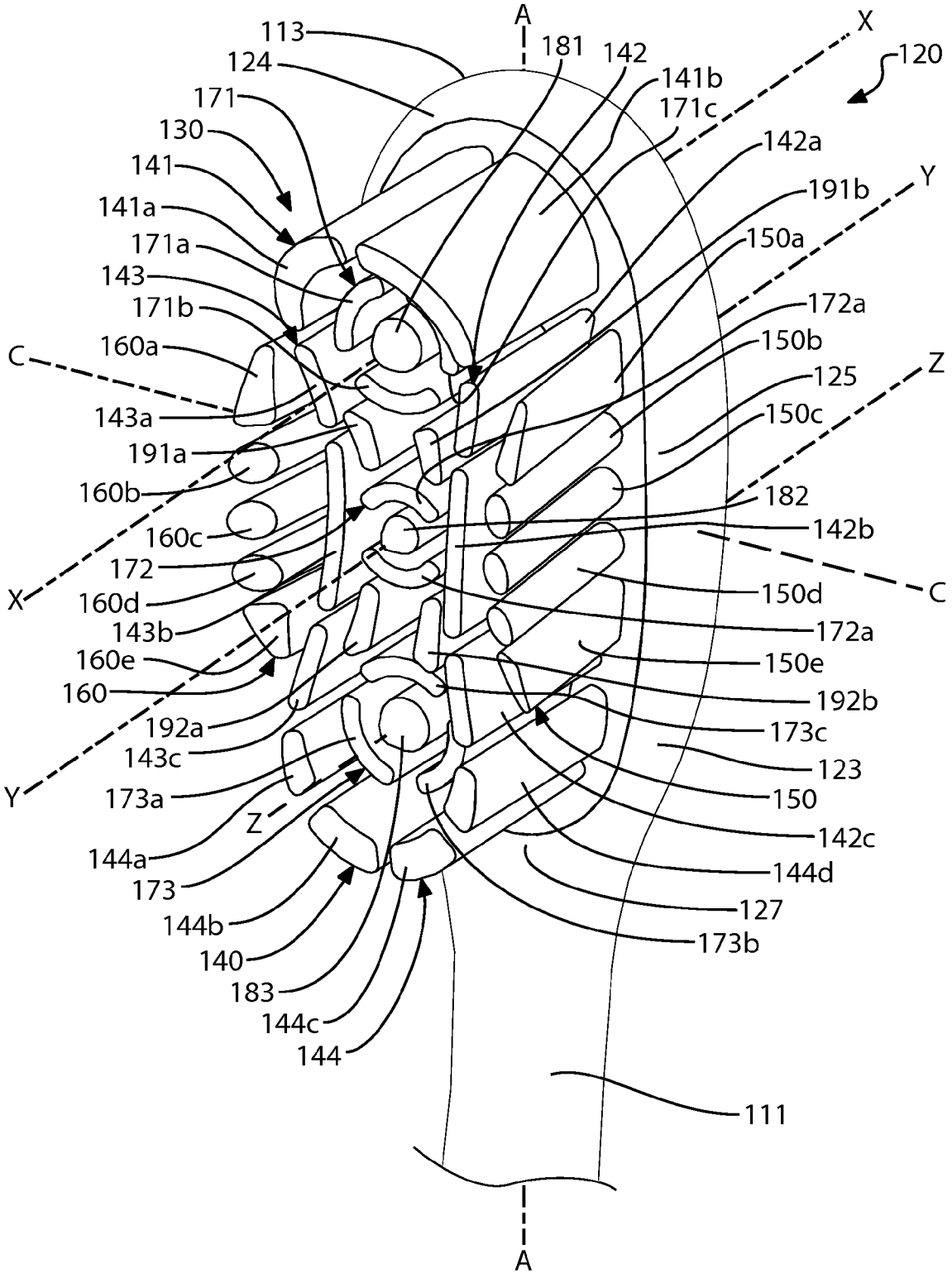
FIG. 6 is a close-up perspective view of the head of the toothbrush of FIG. 1.
Figure 7:
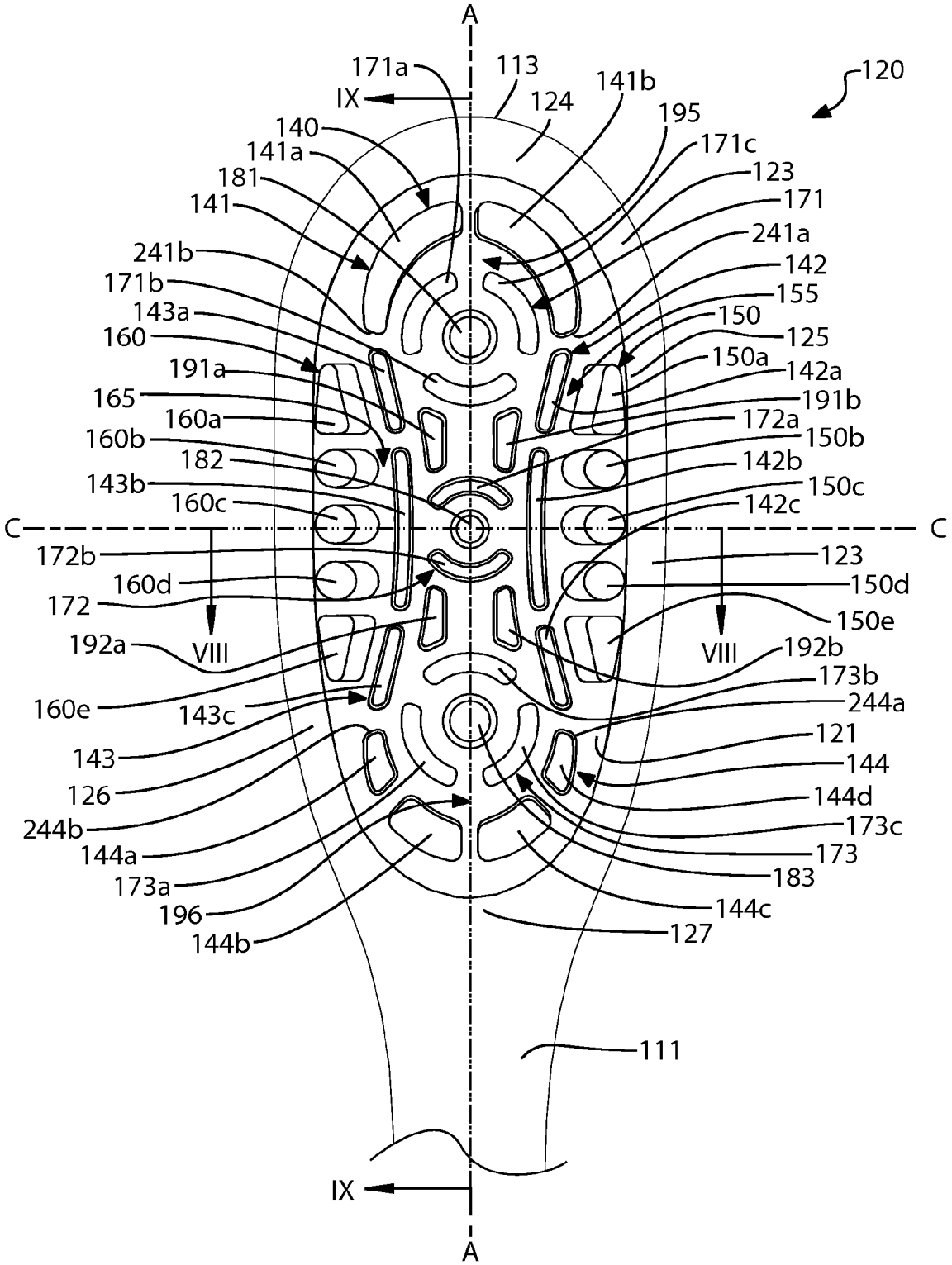
FIG. 7 is a close-up front view of the head of the toothbrush of FIG. 1.

Referring now to FIGS. 6 and 7 concurrently, the details of the head 120 and the collection 130 of cleaning elements extending therefrom will be described in accordance with an embodiment of the present invention. The head 120 of the toothbrush comprises a longitudinal axis A-A and a lateral axis C-C. Generally, the collection 130 of cleaning elements comprises a first set 140 of cleaning elements, a second set 150 of cleaning elements, a third set 160 of cleaning elements, and a plurality of prophylaxis cups 171-173.

The first set 140 of cleaning elements generally comprises a distal par-elliptical wall 141 of cleaning elements, two arcuate rows 142-143 of cleaning elements, and a proximal par-elliptical wall 144. The distal par-elliptical wall 141 is formed by the cleaning elements 141*a-b*. The proximal par-elliptical wall 144 is formed by the cleaning elements 144*a-d*. The first arcuate row 142 is formed by cleaning elements 142*a-c* while the second arcuate row 143 is formed by cleaning elements 143*a-c*.

The second set 150 of cleaning elements are arranged in a row along the lateral periphery 125 of the head 120. Similarly, the third set 160 of cleaning elements are arranged in a row along the lateral periphery 126 of the head 120. Specifically, the row formed by the first set 150 of cleaning elements comprises cleaning elements 150*a-e* while the row formed by the second set 160 of cleaning elements comprises cleaning elements 160*a-e*.

Preferably, all of the cleaning elements of the distal par-elliptical wall 141, the two arcuate rows 142-143, and the proximal par-elliptical wall 144 are formed by densely packed bristles. However, the invention is not so limited and one, a few, or all of these cleaning elements can be formed of another material, such as an elastomer, etc. Moreover, while the distal par-elliptical wall 141, the two arcuate rows 142-143, and the proximal par-elliptical wall 144 are illustrated as being formed by two, three and four cleaning elements respectively, each of the distal par-elliptical wall 141, the two arcuate rows 142-143, and the proximal par-elliptical wall 144 can be formed by more or less cleaning elements than the illustrated embodiment. Moreover, it is even possible that the distal par-elliptical wall 141, the two arcuate rows 142-143, and the proximal par-elliptical wall 144 be formed as a single cleaning element wall.

The prophylaxis cup 171 is formed by three arcuate elastomeric wall sections 171*a-c*. Similarly, the prophylaxis cup 173 is formed by three arcuate elastomeric wall sections 172*a-c*. The central prophylaxis cup 172 is formed by two arcuate elastomeric wall sections 172*a-b*. Of course, each of the prophylaxis cups 171-173 can be constructed by more or less sections than the illustrated embodiment and can be constructed of other materials, such as densely packed bristles. Suitable elastomeric materials include any biocompatible resilient material suitable for uses in an oral hygiene apparatus. To provide optimum comfort as well as cleaning benefits, the elastomeric material preferably has a hardness property in the range of A10 to A40 Shore hardness, and preferably A25 Shore hardness. One preferred elastomeric material is styrene-ethylene/butylene-styrene block copolymer (SEBS) manufactured by GLS Corporation. Nevertheless, SEBS material from other manufacturers or other materials within and outside the noted hardness range could be used.

All of the prophylaxis cups 171-173 are arranged within a loop, which is preferably a substantially closed loop, formed by the first set of cleaning elements 140 (which will be discussed in greater detail below). The prophylaxis cups 171-173 are also arranged along the longitudinal axis A-A of the head. The prophylaxis cup 172 is also located on the lateral axis C-C of the head 120.

In further relation to the first set of cleaning elements 140, the prophylaxis cup 171 is located within the distal par-elliptical wall 141 and the prophylaxis cup 173 is located within the proximal par-elliptical wall 144. The prophylaxis cup 172 is centrally located between the two arcuate rows 142-143.

An elongated central cleaning element 181-183 is located within each of the prophylaxis cups 171-173 and extends upward from the first surface 121 of the head 120 in a substantially normal manner. Specifically, the central cleaning element 181 is located within the prophylaxis cup 171 and extends along a central axis X-X of the prophylaxis cup 171. The central cleaning element 182 is located within the prophylaxis cup 172 and extends along a central axis Y-Y of the prophylaxis cup 172. The central cleaning element 183 is located within the prophylaxis cup 173 and extends along a central axis Z-Z of the prophylaxis cup 173. Each of the elongated cleaning elements 181-183 is preferably taller than its respective prophylaxis cup 171-173 and extends above its top surface. Each of the elongated central cleaning elements 181-183 terminate in a cleaning end that is preferably a cone-like tip. Of course, the invention is not so limited and the cleaning ends of the central cleaning elements 181-183 can take on other shapes. The central cleaning elements 181-183 are preferably densely packed bristle tufts but can be elastomeric fingers if desired. In some embodiments of the invention, the elongated cleaning elements 181-183 may be omitted all together.

A first pair of elongated cleaning elements 191*a-b* is also located within the substantially closed loop formed by the first set 140 of cleaning elements. The first pair of elongated cleaning elements 191*a-b* is located between the first prophylaxis cup 171 and the second prophylaxis cup 172. Similarly, a second pair of elongated cleaning elements 192*a-b* is located within the substantially closed loop formed by the first set 140 of cleaning elements. The second pair of elongated cleaning elements 192*a-b* is located between the second prophylaxis cup 172 and the second prophylaxis cup 173

Referring solely now to FIG. 7, the details of the front profile of the first set 140 of cleaning elements will be discussed. Collectively, the distal par-elliptical wall 141 of cleaning elements, the two arcuate rows 142-143 of cleaning elements, and the proximal par-elliptical wall 144 form a substantially closed-loop that extends from the distal periphery 124 of the head 120 to the proximal periphery 127 of the head 120. The substantially closed-loop formed by the distal par-elliptical wall 141 of cleaning elements, the two arcuate rows 142-143 of cleaning elements, and the proximal par-elliptical wall 144 is also symmetrically located along the longitudinal axis A-A of the head 120. As best visible in FIG. 7, the substantially closed-loop resembles a racetrack in shape. Of course, other shapes can be utilized in certain alternative embodiments.

The distal par-elliptical wall 141 circumferentially extends from a first end 241*a* to a second end 241*b*. The distal par-elliptical wall 141 circumferentially extends at least 180 degrees, and in the illustrated embodiment extends about 180 degrees. The proximal par-elliptical wall 144 circumferentially extends from a first end 244*a* to a second end 244*b*. The proximal par-elliptical wall 144 circumferentially extends at least 180 degrees, and in the illustrated embodiment extends about 180 degrees.

The first arcuate row 142 extends from the first end 241*a* of the distal par-elliptical wall 141 to the first end 244*a* of the proximal par-elliptical wall 144. Similarly, the second arcuate row 143 extends from the second end 241*b* of the distal par-elliptical wall 141 to the second end 244*a* of the proximal par-elliptical wall 144. The first and second arcuate rows 142, 143 are arranged on the head 120 so as to be symmetrically located about both the longitudinal axis A-A and the lateral axis C-C of the head. The first and second arcuate rows 142, 143 are separated by a distance D that increases with distance from the lateral axis C-C. The arcuate rows 142, 143 are arranged so that their convex peripheral surfaces oppose one another.

Figure 8:
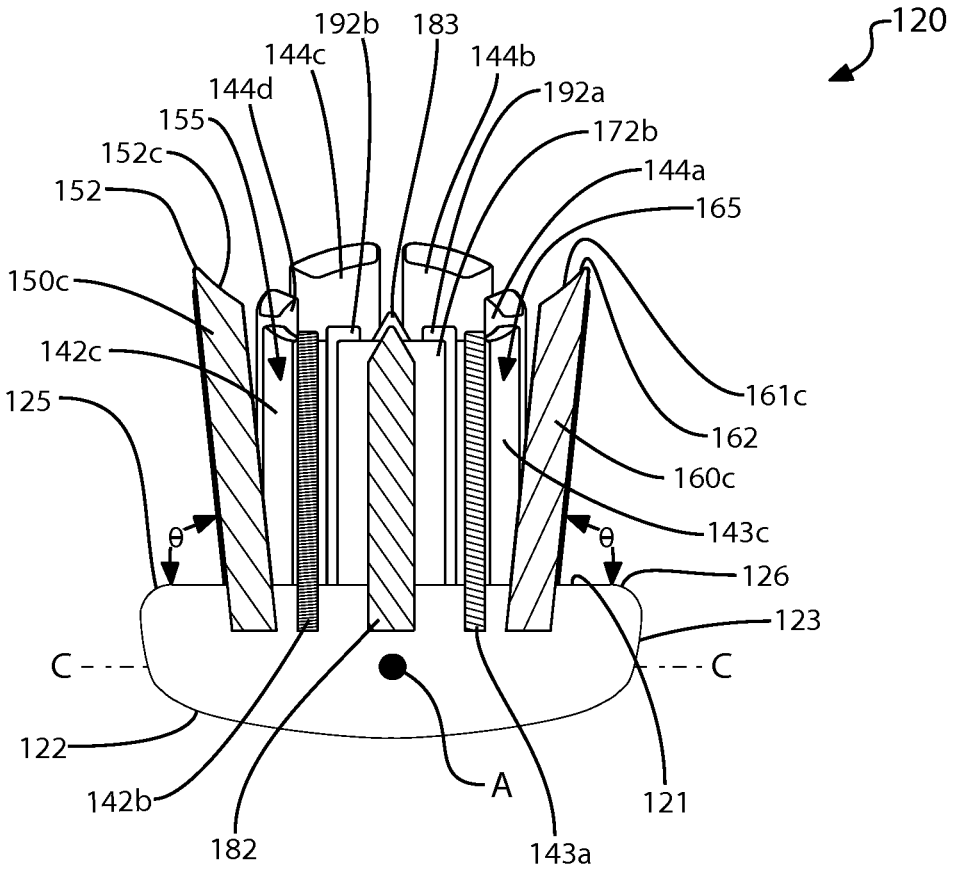
FIG. 8 is a cross-sectional view of the head of the toothbrush of FIG. 1 along view VIII-VIII of FIG. 7.
Figure 9:
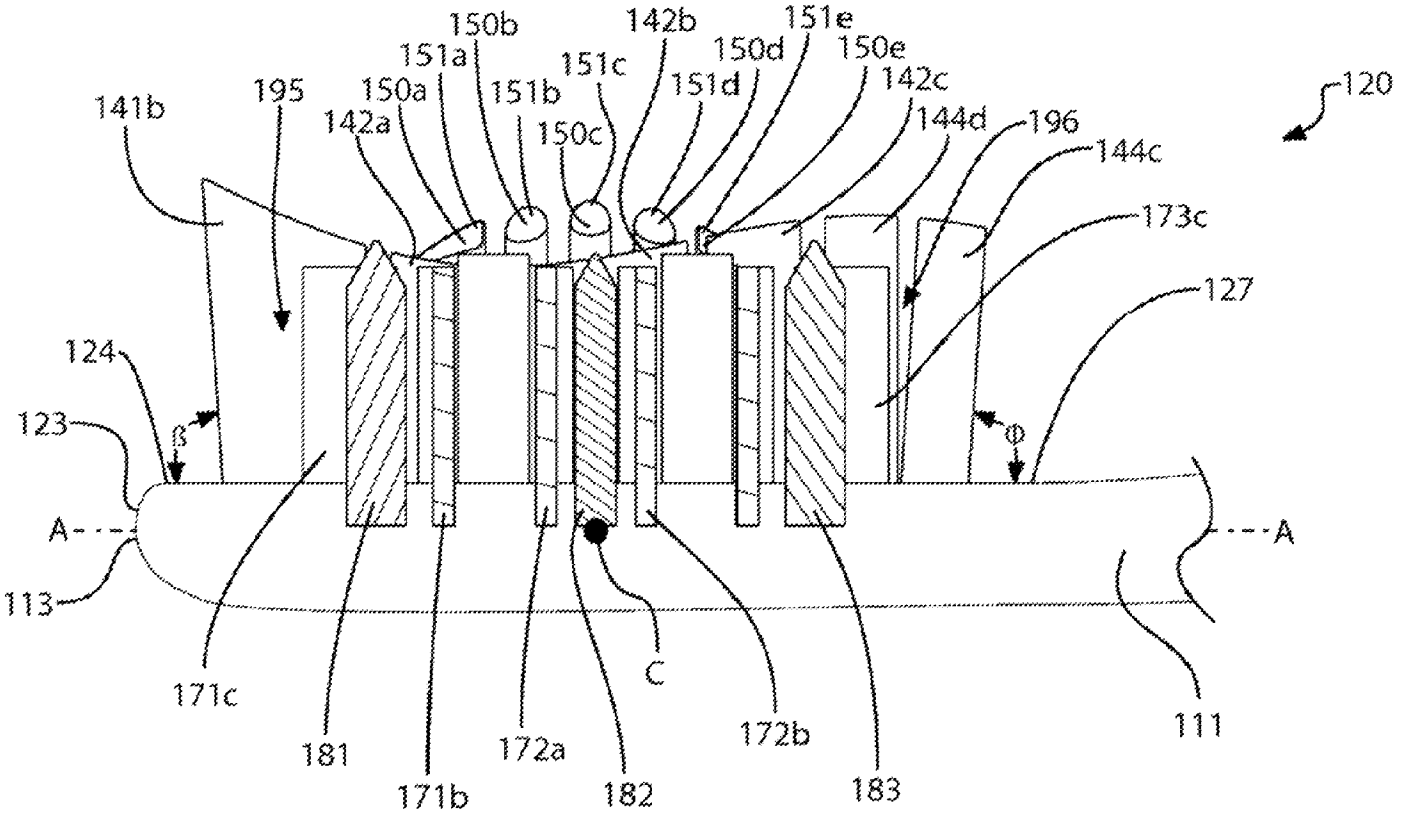
FIG. 9 is a cross-sectional view of the head of the toothbrush of FIG. 1 along view IX-IX of FIG. 7.

Referring now to FIGS. 7-9 concurrently, the details of the second and third sets 150, 160 of cleaning elements will be discussed, along with their relationship to the first set 140 of cleaning elements and the head 120. As mentioned above, the third and second sets 150, 160 of cleaning elements are arranged in rows along the first and second lateral peripheries 125, 126 of the head 120 respectively. The cleaning elements 160*a-e* extend from the first surface 121 of the head 120 at a non-normal angle Θ so that the cleaning elements 160*a-e* extend from the first surface 121 of the head 120 so as to diverge from the second row 143 of cleaning elements (which preferably extend from the first surface 121 at a substantially normal angle). Similarly, the cleaning elements 150*a-e* extend from the first surface 121 of the head 120 at a non-normal angle Θ so that the cleaning elements 150*a-e* extend from the first surface 121 of the head 120 so as to diverge from the first row 142 of cleaning elements (which preferably extend from the first surface 121 at a substantially normal angle). Preferably, the angle Θ is in the range of 75 to 89 degrees, and most preferably 86 degrees.

A longitudinal channel 165 is formed between the third set 160 of cleaning elements 160*a-e* and the third row 143 of cleaning elements 143*a-c*. Similarly, a longitudinal channel 155 is formed between the second set 150 of cleaning elements 150*a-e* and the second row 142 of cleaning elements 142*a-c*. The longitudinal channels 155, 165 provides a cavity for receiving and retaining dentifrice during oral care.

The cleaning elements 160*a-e* of the third set 160 terminate in cleaning ends 161*a-e*. The cleaning ends 161*a-e* are preferably tapered so as to form a longitudinal edge 162 along the row formed by the third set 160 of cleaning elements 160*a-e*. Similarly, the cleaning elements 150*a-e* of the second set 150 terminate in cleaning ends 151*a-e*. The cleaning ends 151*a-e* are preferably tapered so as to form a second longitudinal edge 152 along the row formed by the third set 150 of cleaning elements 150*a-e*. The tapered and inclined nature of the second and third rows 150, 160 of cleaning elements 150*a-e*, 160*a-e* not only affords increased cleaning of the teeth along the gum line during brushing but also provides a means by which to direct dentifrice into those areas.

As best visible in FIG. 9, the second and third sets 150, 160 of cleaning elements 150*a-e*, 160*a-e* are taller than the second and third rows 142, 143 of cleaning elements 142*a-c*, 143*a-c* respectively. Stated another way, the second and third sets 150, 160 of cleaning elements 150*a-e*, 160*a-e* have a maximum height that is greater than the maximum height of the second and third rows 142, 143 of cleaning elements 142*a-c*, 143*a-c* respectively. As used herein, a height is the normal distance from the first surface 121 of the head 120 to the uppermost portion of the subject element.

Referring now to FIGS. 7 and 9 concurrently, as discussed above, the prophylaxis cup 171 is located within the distal par-elliptical wall 141 and the prophylaxis cup 173 is located within the proximal par-elliptical wall 144. As a result an annular channel 195 exists between the prophylaxis cup 171 and the distal par-elliptical wall 141. Similarly, an annular channel 196 exists between the prophylaxis cup 173 and the proximal par-elliptical wall 144. These annular channels 195, 196 provide cavities for receiving and further retaining dentifrice during oral care.

As can be seen in FIG. 9, the distal-most portion of the first par-elliptical wall 141 extends upward from the first surface 121 of the head 120 in an inclined manner at an angle β away from the handle 110. Preferably, the angle θ is in the range of 75 to 89 degrees, and most preferably 86 degrees. Conversely, the proximal-most portion of the second par-elliptical wall 144 extends upward from the first surface 121 of the head 120 in an inclined manner at an angle Φ toward the handle 110. Preferably, the angle Φ is in the range of 75 to 89 degrees, and most preferably 86 degrees.

Figure 10:
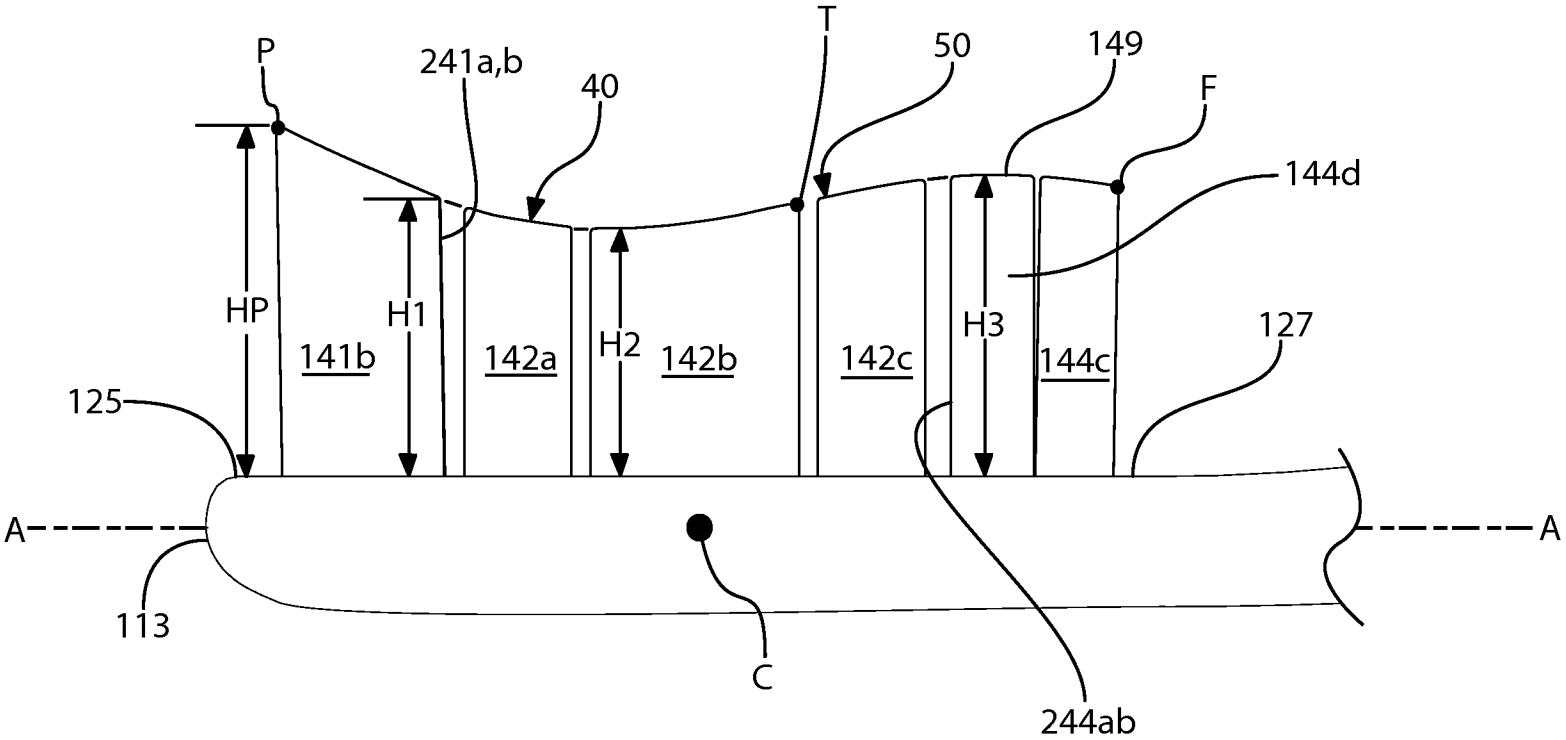
FIG. 10 is a left-side view of the toothbrush of FIG. 1 wherein certain cleaning elements have been removed to clearly show a lateral side profile of the substantially closed-loop formed by the first set of cleaning elements.

Referring now to FIGS. 7 and 10 concurrently, the contour of the substantially closed-loop formed by the first set 140 of cleaning elements will be discussed. FIG. 10 illustrates a simplified longitudinal side profile of the top surface of the substantially closed-loop formed by distal par-elliptical wall 141, the two arcuate rows 142-143, and the proximal par-elliptical wall 144. As can be seen, the top surface 149 has a lateral side profile comprising a concave section 40 that extends from a peak P at a distal-most point of the distal par-elliptical wall 141 to a transition point T at a middle-portion of the two arcuate rows 142-143. The lateral side profile also comprises a convex section 50 that extends from the transition point T to a proximal-most point F of the second par-elliptical wall 144. The longitudinal side profile is essentially a stretched out S-shape.

Described another way, the first par-elliptical wall 141 has a first height H1 at the first and second ends 241*a,b* and a peak height HP at the location where the first par-elliptical wall 144 intersects (or hypothetically would intersect) the longitudinal axis A-A The first par-elliptical wall 144 slopes upward from the first height H1 to the peak height HP moving from the first and second ends 241*a,b* to the location P where the first par-elliptical wall intersects the longitudinal axis A-A. When moving from the first par-elliptical wall 141 to the second par-elliptical wall 144, the height of the first and second rows 142, 143 slopes downward for first a portion until a height H2 is reached. After this, the height of the first and second rows 142, 143 then slopes upward for a second portion until a height H3 is reached. At all points, the second par-elliptical wall 144 preferably has a height that is greater than the height H2 and less than the peak height HP.

While a number of embodiments of the current invention have been described and illustrated in detail, various alternatives and modifications will become readily apparent to those skilled in the art without departing from the spirit and scope of the invention. As various changes could be made in the above methods, compositions and structures without departing from the scope of the invention, it is intended that all matter contained in this application, including all mechanisms and/or modes of interaction described above, shall be interpreted as illustrative only and not limiting in any way the scope of the appended claims.

What is claimed is:

1. A toothbrush comprising:

a handle;

a head connected to the handle, the head having a proximal periphery, a distal periphery, a first surface, a longitudinal axis and a lateral axis;

a first set of cleaning elements forming a loop that extends from the distal periphery of the head to the proximal periphery of the head, the loop being symmetric about the lateral axis, the first set of cleaning elements comprising:

a first par-elliptical wall of cleaning elements located at the distal periphery of the head, the first par-elliptical wall terminating in a first end and a second end;

a second par-elliptical wall of cleaning elements located at the proximal periphery of the head, the second par-elliptical wall terminating in a first end and a second end;

a first row of cleaning elements extending from the first end of the first par-elliptical wall to the first end of the second par-elliptical wall; and a second row of cleaning elements extending from the second end of the first par-elliptical wall to the second end of the second par-elliptical wall;

wherein the first and second rows are symmetrically arranged about the longitudinal axis and the lateral axis, the first and second rows separated from each other by a transverse distance that only increases with longitudinal distance from the lateral axis;

a third row of cleaning elements extending adjacent to the first row and located along a first lateral periphery of the head, the third row located outside of the loop, the third row extending upward from the first surface at an incline so as to diverge from the first row, the third row having a height that is greater than a height of the first row; and a fourth row of cleaning elements extending adjacent to the second row and located along a second lateral periphery of the head, the fourth row located outside of the loop, the fourth row extending upward from the first surface at an incline so as to diverge from the second row, the fourth row having a height that is greater than a height of the second row wherein free ends of the cleaning elements of each of the third and fourth rows form a concave longitudinal side profile; wherein free ends of the cleaning elements of each of the first and second rows form a concave longitudinal side profile; wherein the concave longitudinal side profile of the first row is in transverse alignment with the convex longitudinal side profile of the third row; wherein the concave longitudinal side profile of the second row is in transverse alignment with the convex longitudinal side profile of the fourth row.

2. The toothbrush of claim 1 wherein the first par-elliptical wall has a first height at the first and second ends of the first par-elliptical wall and a peak height at a location where the first par-elliptical wall intersects the longitudinal axis, the first par-elliptical wall sloping upward from the first height to the peak height moving from the first and second ends of the first par-elliptical wall to the location where the first par-elliptical wall intersects the longitudinal axis; wherein moving from the first par-elliptical wall to the second par-elliptical wall, the height of the first and second rows slopes downward for a first portion and then slopes upward for a second portion; and wherein the second par-elliptical wall has a height that is less than the peak height.

3. The toothbrush of claim 2 wherein the third and fourth rows of cleaning elements have top surfaces that are tapered so as to form first and second lateral edges respectively.

4. The toothbrush of claim 1 wherein the first set of cleaning elements are densely packed bristles.

5. The toothbrush of claim 1 wherein the first and second rows are arcuate walls.

6. The toothbrush of claim 5 wherein the third and fourth rows are symmetrically arranged about the longitudinal and lateral axes of the head.

7. The toothbrush of claim 6 wherein a first channel is formed between the first and third rows and a second channel is formed between the second and fourth rows.

8. The toothbrush of claim 1 wherein the third row has a first end and a second end, the third row extending so that the first end of the third row is adjacent an outer surface of the first par-elliptical wall and the second end of the third row is adjacent an outer surface of the second par-elliptical wall; and wherein the fourth row has a first end and a second end, the fourth row extending so that the first end of the fourth row is adjacent an outer surface of the first par-elliptical wall and the second end of the fourth row is adjacent an outer surface of the second par-elliptical wall.

9. The toothbrush of claim 1 wherein the first and second par-elliptical walls circumferentially extend at least 180 degrees.

10. The toothbrush of claim 1 further comprising;

a first elastomeric cup located within the first par-elliptical wall;

a second elastomeric cup located between the first and second rows; and a third elastomeric cup located within the second par-elliptical wall.

11. The toothbrush of claim 1 wherein a distal-most portion of the first par-elliptical wall of cleaning elements extends upward from the first surface of the head in an inclined manner away from the handle; and wherein a proximal-most portion of the second par-elliptical wall of cleaning elements extends upward from the first surface of the head in an inclined manner toward the handle.

12. The toothbrush of claim 10 further comprising a first annular gap between the first elastomeric cup and the first par-elliptical wall and a second annular gap between the second elastomeric cup and the second par-elliptical wall.

13. The toothbrush of claim 10 wherein the first, second and third elastomeric cups are located along the longitudinal axis of the head.

14. The toothbrush of claim 10 further comprising:

a first elongated cleaning element extending along a central axis of the first elastomeric cup, the first elongated cleaning element being taller than the first elastomeric cap;

a second elongated cleaning element extending along a central axis of the second elastomeric cup, the second elongated cleaning element being taller than the second elastomeric cup; and a third elongated cleaning element extending along a central axis of the third elastomeric cup, the third elongated cleaning element being taller than the third elastomeric cup.

15. The toothbrush of claim 14 wherein the first and third elastomeric cups are formed by three arcuate wall sections, and the second elastomeric cup is formed by two arcuate wall sections.

16. The toothbrush of claim 10 further comprising a first pair of elongated cleaning elements located axially between the first and second elastomeric cups within the loop and a second pair of elongated cleaning elements located axially between the second and third elastomeric cups within the loop.

17. A toothbrush comprising:

a handle;

a head connected to the handle, the head having a proximal periphery, a distal periphery, a first surface and a longitudinal axis;

a first set of cleaning elements forming a loop that extends from the distal periphery of the head to the proximal periphery of the head, the first set of cleaning elements comprising:

a first par-elliptical wall of bristles located at the distal periphery of the head, the first par-elliptical wall terminating in a first end and a second end;

a second par-elliptical wall of bristles located at the proximal periphery of the head, the second par-elliptical wall terminating in a first end and a second end;

a first row of bristles extending from the first end of the first par-elliptical wall to the first end of the second par-elliptical wall; and a second row of bristles extending from the second end of the first par-elliptical wall to the second end of the second par-elliptical wall;

a third row of bristles extending adjacent to the first row and located along a first lateral periphery of the head, the third row located outside of the loop, the third row extending upward from the first surface at an incline so as to diverge from the first row, the third row having, a height that is greater than a height of the first row; and a fourth row of bristles extending adjacent to the second row and located along a second lateral periphery of the head, the fourth row located outside of the loop, the fourth row extending upward from the first surface at an incline so as to diverge from the second row, the fourth row having a height that is greater than a height of the second row wherein free ends of the bristles of each of the third and fourth rows form a concave longitudinal side profile; wherein free ends of the bristles of each of the first and second rows form a concave longitudinal side profile; wherein the concave longitudinal side profile of the first row is in transverse alignment with the convex longitudinal side profile of the third row; wherein the concave longitudinal side profile of the second row is in transverse alignment with the convex longitudinal side profile of the fourth row.

18. The toothbrush of claim 17 wherein the first and second rows are symmetrically arranged about the longitudinal axis and a lateral axis of the head, the first and second rows separated from each other by a transverse distance that only increases with longitudinal distance from the lateral axis.

19. The toothbrush of claim 18 wherein the first and second rows are arcuate walls.

20. The toothbrush of claim 17 wherein the first par-elliptical wall has a first height at the first and second ends of the first par-elliptical wall and a peak height at a location where the first par-elliptical wall intersects the longitudinal axis, the first par-elliptical wall sloping upward from the first height to the peak height moving from the first and second ends of the first wall to the location where the first par-elliptical wall intersects the longitudinal axis; wherein moving from the first par-elliptical wall to the second par-elliptical wall, the height of the first and second rows slopes downward for a first portion and then slopes upward for a second portion; and wherein the second par-elliptical wall has a height that is less than the peak height.

21. The toothbrush of claim 17 wherein the bristles of each of the first par-elliptical wall, the second par-elliptical wall, the first row and the second row are densely packed filament bristles and wherein the bristles of the third and fourth rows are filament bristles.

22. A toothbrush comprising:

a handle;

a head connected to the handle, the head having a proximal periphery, a distal periphery, a first surface, a lateral axis and a longitudinal axis;

a first set of cleaning elements forming a loop that extends from the distal periphery of the head to the proximal periphery of the head, the loop being symmetric about the lateral axis, the first set of cleaning elements comprising:

a first par-elliptical wall of cleaning elements located at the distal periphery of the head, the first par-elliptical wall terminating in a first end and a second end;

a second par-elliptical wall of cleaning elements located at the proximal periphery of the head, the second par-elliptical wall terminating in a first end and a second end;

a first arcuate row of cleaning elements extending from the first end of the first par-elliptical wall to the first end of the second par-elliptical wall; and a second arcuate row of cleaning elements extending from the second end of the first par-elliptical wall to the second end of the second par-elliptical wall;

wherein the first and second arcuate rows are symmetrically arranged about the longitudinal axis so that peripheral convex surfaces of the first and second arcuate rows face the longitudinal axis; and wherein the peripheral convex surface of the first arcuate row extends from the first end of the first par-elliptical wall to the first end of the second par-elliptical wall and wherein the peripheral convex surface of the second arcuate row extends from the second end of the first par-elliptical wall to the second end of the second par-elliptical wall a third row of cleaning elements extending adjacent to the first row and located along a first lateral periphery of the head, the third row located outside of the loop, the third row extending upward from the first surface at an incline so as to diverge from the first row, the third row having a height that is greater than a height of the first row; and a fourth row of cleaning elements extending adjacent to the second row and located along a second lateral periphery of the head, the fourth row located outside of the loop, the fourth row extending upward from the first surface at an incline so as to diverge from the second row, the fourth row having a height that is greater than a height of the second row; wherein free ends of the cleaning elements of each of the third and fourth rows form a concave longitudinal side profile; wherein free ends of the cleaning elements of each of the first and second rows form a concave longitudinal side profile; wherein the concave longitudinal side profile of the first row is in transverse alignment with the convex longitudinal side profile of the third row; wherein the concave longitudinal side profile of the second row is in transverse alignment with the convex longitudinal side profile of the fourth row.

23. The toothbrush of claim 22 wherein the first par-elliptical wall has a first height at the first and second ends of the first par-elliptical wall and a peak height at a location where the first par-elliptical wall intersects the longitudinal axis, the first par-elliptical wall sloping upward from the first height to the peak height moving from the first and second ends of the first par-elliptical wall to the location where the first par-elliptical wall intersects the longitudinal axis; wherein moving from the first par-elliptical wall to the second par-elliptical wall, the height of the first and second arcuate rows slopes downward for a first portion and then slopes upward for a second portion; and wherein the second par-elliptical wall has a height that is less than the peak height.

24. A toothbrush comprising:

a handle;

a head connected to the handle, the head having a proximal periphery, a distal periphery, a first surface, a lateral and a longitudinal axis;

a first set of cleaning elements forming a loop that extends from the distal periphery of the head to the proximal periphery of the head, the loop being symmetric about the lateral axis, the first set of cleaning elements comprising:

a first par-elliptical wall of cleaning elements located at the distal periphery of the head, the first par-elliptical wall terminating in a first end and a second end;

a second par-elliptical wall of cleaning elements located at the proximal periphery of the head, the second par-elliptical wall terminating in at first end and a second end;

a first arcuate row of cleaning elements having a peripheral convex surface facing the longitudinal axis, the peripheral convex surface of the first arcuate row extending from the first end of the first par-elliptical wall to the first end of the second par-elliptical wall; and a second arcuate row of cleaning elements having a peripheral convex surface facing the longitudinal axis, the peripheral convex surface of the second arcuate row extending from the second end of the first par-elliptical wall to the second end of the second par-elliptical wall; and wherein the first and second arcuate rows are symmetrically arranged about the longitudinal axis and the lateral axis of the head, the first and second arcuate rows separated from each other by a transverse distance that only increases with longitudinal distance from the lateral axis a third row of cleaning elements extending adjacent to the first arcuate row and located along a first lateral periphery of the head, the third row located outside of the loop, the third row extending upward from the first surface at an incline so as to diverge from the first arcuate row, the third row having a height that is greater than a height of the first arcuate row; and a fourth row of cleaning elements extending adjacent to the second arcuate row and located along a second lateral periphery of the head, the fourth row located outside of the loop, the fourth row extending upward from the first surface at an incline so as to diverge from the second arcuate row, the fourth row having a height that is greater than a height of the second arcuate row; wherein free ends of the cleaning elements of each of the third and fourth rows form a concave longitudinal side profile; wherein free ends of the cleaning elements of each of the first and second rows form a concave longitudinal side profile; wherein the concave longitudinal side profile of the first row is in transverse alignment with the convex longitudinal side profile of the third row; wherein the concave longitudinal side profile of the second row is in transverse alignment with the convex longitudinal side profile of the fourth row.

25. The toothbrush of claim 24 further comprising;

a first elastomeric cup located within the first par-elliptical wall;

a second elastomeric cup located between the first and second rows; and a third elastomeric cup located within the second par-elliptical wall.

26. The toothbrush of claim 25 further comprising a first annular gap between the first elastomeric cup and the first par-elliptical wall and a second annular gap between the second elastomeric cup and the second par-elliptical wall.

27. The toothbrush of claim 25 further comprising;

a first elongated cleaning element extending along a central axis of the first elastomeric cup that is taller than the first elastomeric cup;

a second elongated cleaning element extending along a central axis of the second elastomeric cup that is taller than the second elastomeric cup; and a third elongated cleaning, element extending along a central axis of the third elastomeric cup that is taller than the third elastomeric cup.

28. The toothbrush of claim 27 further comprising a first pair of elongated cleaning elements located axially between the first and second elastomeric cups within the loop and a second pair of elongated cleaning elements located axially between the second and third elastomeric cups within the loop.

29. The toothbrush of claim 24 wherein the longitudinal axis intersects the lateral axis at a center point of the head.

30. The toothbrush of claim 24 wherein a distal-most portion of the first par-elliptical wall of cleaning elements extends upward from the first surface of the had in an inclined manner away from the handle; and wherein a proximal-most portion of the second par-elliptical wall of cleaning elements extends upward from the first surface of the head in an inclined manner toward the handle.

31. A toothbrush comprising:

a handle;

a head connected to the handle, the head having a proximal periphery, a distal periphery, a first surface and a longitudinal axis;

a set of bristles forming a loop that extends from the distal periphery of the head to the proximal periphery of the head; and wherein a top surface of the loop has a longitudinal side profile comprising a concave section that extends from a peak at a distal-most point of the loop to a transition point at a middle-portion of the loop, and a convex section that extends from the transition point to a proximal-most point of the loop; and a third row of cleaning elements extending adjacent to the loop and located along a first lateral periphery of the head, the third row located outside of the loop, the third row extending upward from the first surface at an incline so as to diverge from the loop, the third row having a height that is greater than a height of the concave section of the loop; and a fourth row of cleaning elements extending adjacent to the loop and located along a second lateral periphery of the head, the fourth row located outside of the loop, the fourth row extending upward from the first surface at an incline so as to diverge from the loop, the fourth row having a height that is greater than a height of the concave section of the loop; wherein free ends of the cleaning elements of each of the third and fourth rows form a convex longitudinal side profile; wherein the concave longitudinal side profile of the loop is in transverse alignment with the convex longitudinal side profile of the third row; wherein the concave longitudinal side profile of the loop is in transverse alignment with the convex longitudinal side profile of the fourth row.

32. The toothbrush of claim 31 wherein the head further comprises a lateral axis, and wherein the loop is substantially symmetric about the lateral axis.

33. The toothbrush of claim 31 wherein the set of bristles are densely packed filament bristles.

* * * * *